US006234748B1

(12) United States Patent
Brown et al.

(10) Patent No.: US 6,234,748 B1
(45) Date of Patent: May 22, 2001

(54) WEAR RING ASSEMBLY FOR A CENTRIFUGAL PUMP

(75) Inventors: Jeffrey S. Brown, Plainfield; Manfred P. Klein, Highland Park; Scott A. McAloon, Lombard; Peter E. Phelps, Darien, all of IL (US)

(73) Assignee: Innovative Mag-Drive, L.L.C., Chicago, IL (US)

( * ) Notice: Subject to any disclaimer, the term of this patent is extended or adjusted under 35 U.S.C. 154(b) by 0 days.

(21) Appl. No.: 09/428,724

(22) Filed: Oct. 28, 1999

Related U.S. Application Data

(60) Provisional application No. 60/106,103, filed on Oct. 29, 1998.

(51) Int. Cl.[7] ..... F04D 29/18
(52) U.S. Cl. ..... 415/170.1
(58) Field of Search ..... 415/172.1, 173.4, 415/174.4, 170.1; 417/420

(56) References Cited

U.S. PATENT DOCUMENTS

| | | | | |
|---|---|---|---|---|
| 4,047,847 | | 9/1977 | Oikawa | 417/370 |
| 4,208,166 | | 6/1980 | Schroeder et al. | 415/170 A |
| 4,226,574 | | 10/1980 | Villette | 417/420 |
| 4,245,952 | * | 1/1981 | Eberhardt | 415/172.1 |
| 4,435,126 | | 3/1984 | Schneider | 416/186 R |
| 4,644,202 | | 2/1987 | Kroy et al. | 310/58 |
| 4,793,777 | | 12/1988 | Hauenstein | 417/365 |
| 4,806,080 | * | 2/1989 | Mizobuchi et al. | 415/170.1 |
| 4,828,454 | | 5/1989 | Morris et al. | 415/48 |
| 4,867,633 | | 9/1989 | Gravelle | 415/106 |
| 4,867,638 | * | 9/1989 | Handtmann et al. | 415/172.1 |
| 4,913,619 | * | 4/1990 | Haentjens et al. | 415/172.1 |
| 4,948,336 | * | 8/1990 | Mosure | 415/172.1 |
| 5,061,151 | | 10/1991 | Steiger | 415/106 |
| 5,127,792 | | 7/1992 | Katsuta et al. | 415/104 |
| 5,158,440 | | 10/1992 | Cooper et al. | 417/423.1 |
| 5,201,642 | | 4/1993 | Hinckley | 417/420 |
| 5,567,132 | * | 10/1996 | Dupuis et al. | 417/420 |
| 5,615,996 | | 4/1997 | Suzuki et al. | 415/1 |
| 5,641,275 | | 6/1997 | Klein et al. | 417/420 |
| 5,873,697 | | 2/1999 | Gully | 415/172.1 |

OTHER PUBLICATIONS

Karassik Krutzsch, Fraser, and Messina, *Pump Handbook*, 2nd. Ed., McGraw–Hill Book Company, pp. 2.53–2.59.
Robert Neumaier, *Hermetic Pumps*, Gulf Publishing, Houston, Texas, pp. 154–155; 356–359.

* cited by examiner

*Primary Examiner*—Edward K. Look
*Assistant Examiner*—James M McAleenan

(57) ABSTRACT

A wear ring assembly for a pump includes an inner wear ring and an outer wear ring generally coaxially oriented with respect to the inner wear ring. An impeller has an inner recess for receiving the inner wear ring. The inner wear ring has an exterior groove and the inner recess has an interior groove for axial alignment with the exterior groove. The inner wear ring is affixed to the impeller via at least one arcuate retainer for simultaneously engaging the interior groove and the exterior groove.

35 Claims, 8 Drawing Sheets

WEAR RING ASSEMBLY FOR A CENTRIFUGAL PUMP

This document claims the benefit of the filing date of U.S. Provisional Application No. 60/106,103, filed on Oct. 29, 1998, for any common subject matter disclosed in this document and the provisional application.

FIELD OF THE INVENTION

This invention relates to a wear ring assembly for a centrifugal pump.

BACKGROUND

A centrifugal pump may generally include a wear ring assembly for restricting the flow of pumped fluid from a discharge pressure region to a lesser pressure region within the pump. For example, a wear ring assembly may be used to inhibit the flow of fluid that would otherwise occur between a discharge pressure and a suction pressure within a pump.

A wear ring assembly typically has an inner wear ring oriented coaxially with respect to a stationary outer wear ring. The stationary outer wear ring is normally pressed into a pump housing. Variations in radial clearance between the inner wear ring and the outer wear ring result from adding various deviations from ideal dimensions or tolerances within the pump. The inherent limitations of manufacturing processes or materials (e.g., polymers) for manufacturing pumps may lead to deviations from optimum pump tolerances. The inner wear ring does not often have an ideal or entirely concentric rotational relationship with respect to the outer wear ring because of deviations from optimum pump tolerances. Accordingly, during operation of the pump, unwanted frictional contact occurs between the inner and outer wear ring, resulting in heating of the pumped fluid, drag on the drive motor of the pump, and potential contaminants in the pumped fluid from depletion of the surfaces of the wear ring assembly. In addition, if a desired minimal radial clearance between the inner wear ring and the outer wear ring is exceeded because of variations from optimum pump tolerances, the wear ring assembly may provide an inadequate flow barrier between a discharge pressure and a suction pressure of the pump. Thus, a need exists for a pump design or improvement that can compensate for a slightly eccentric relationship or coaxial misalignment between the inner wear ring and the outer wear ring of a wear ring assembly.

In the past, pump designs have featured wear rings pressed onto an outer diameter of an impeller lip. Wear rings pressed onto the outer diameter of an impeller lip typically suffer from two infirmities. First, a wear ring mounted onto the diameter of an impeller tends to be forced off the impeller by hydraulic forces during operation of the pump. The back side of the wear ring experiences discharge pressure with axial forces from fluid that creeps behind the back side. In contrast, the front side of the wear ring experiences suction pressure, which is significantly lower than the discharge pressure. Accordingly, the net hydraulic force acting on the wear ring tries to push it off the impeller toward the inlet of the pump. Even if the net hydraulic force merely slides the wear ring slightly forward toward the pump inlet, a catastrophic failure of the pump may occur. For example, in one failure mode the wear ring jams the rotation of the impeller by contacting stationary casing material which would normally be located axially in front of the wear ring by a clearance dimension.

A second infirmity of the foregoing mounting arrangement, predominately applies in the context of ceramic wear rings. Mounting a ceramic wear ring on the outer diameter of an impeller lip places the wear ring in tension, increasing the chance of failure or breakage of the ceramic wear ring. Ceramic wear rings feature low tensile strength and high compressive strength. Ceramic wear rings can be made radially thicker to compensate for certain tensile forces.

Other pump designs use an elastomer o-ring that engages a groove in a wear ring and an impeller to affix the wear ring to the impeller. The o-ring is composed of a flexible elastomer that has sufficient give to permit assembly. Providing the requisite flexibility of the o-ring typically results in an undesired compromise in structural integrity of the o-ring. Accordingly, the o-ring attachment of the wear ring to the impeller may lack reliability over extended periods of operation. For example, the wear ring may become separated or misaligned with respect to the impeller because the o-ring breaks or yields from a lack of adequate shear or tensile strength during pump operation. Thus, a need exists for a reliable mounting technique for mounting wear rings on an impeller, including ceramic wear rings.

SUMMARY OF THE INVENTION

In accordance with the invention, a wear ring assembly for a pump includes an inner wear ring and an outer wear ring generally coaxially oriented with respect to the inner wear ring. An impeller has an inner recess for receiving the inner wear ring. The inner wear ring has an exterior groove and the inner recess has an interior groove for axial alignment with the exterior groove. The inner wear ring is affixed to the impeller via at least one arcuate retainer for simultaneously engaging the interior groove and the exterior groove.

In one aspect of the invention, the inner wear ring is mounted on an impeller front such that the inner wear ring merely experiences compressive forces, as opposed to tensile forces, from any mechanical interference between the inner wear ring and the inner recess. Accordingly, the above mounting arrangement of the inner wear ring is well-suited for ceramic materials or other materials that offer comparable resistance to compressive forces. Further, during operation of the pump, the inner wear ring on an impeller front is tolerant of hydraulic forces because both a front face and a rear face of the inner wear ring tend to be exposed to the same suction pressure. The mounting of the inner wear ring in the inner recess adjacent to an impeller eye, as opposed to elsewhere on the impeller front, allows for a minimum possible clearance area between the inner wear ring and the outer wear ring to minimize leakage of fluid from the discharge pressure to the suction pressure.

Another aspect of the invention includes an outer recess in a structural support of the pump for receiving the outer wear ring. The recess has a retention channel for accepting an outer retainer having an axially compressible dimension. The outer retainer is adapted to engage the retention channel while protruding radially inward therefrom to retain the outer wear ring. The retainer is biased against the outer wear ring to force the outer wear ring axially into the outer recess. The outer recess preferably has a radial extent greater than that of the outer wear ring to form a radial zone of adjustment for compensating for eccentric misalignment between the inner wear ring and the outer wear ring. The above mounting arrangements lend themselves to fabrication with corrosion-resistant materials, such a ceramic wear rings, and retainers composed of fiber-reinforced polymers, and fiber-reinforced plastics.

DETAILED DESCRIPTION OF PREFERRED EMBODIMENTS

Figure 1:
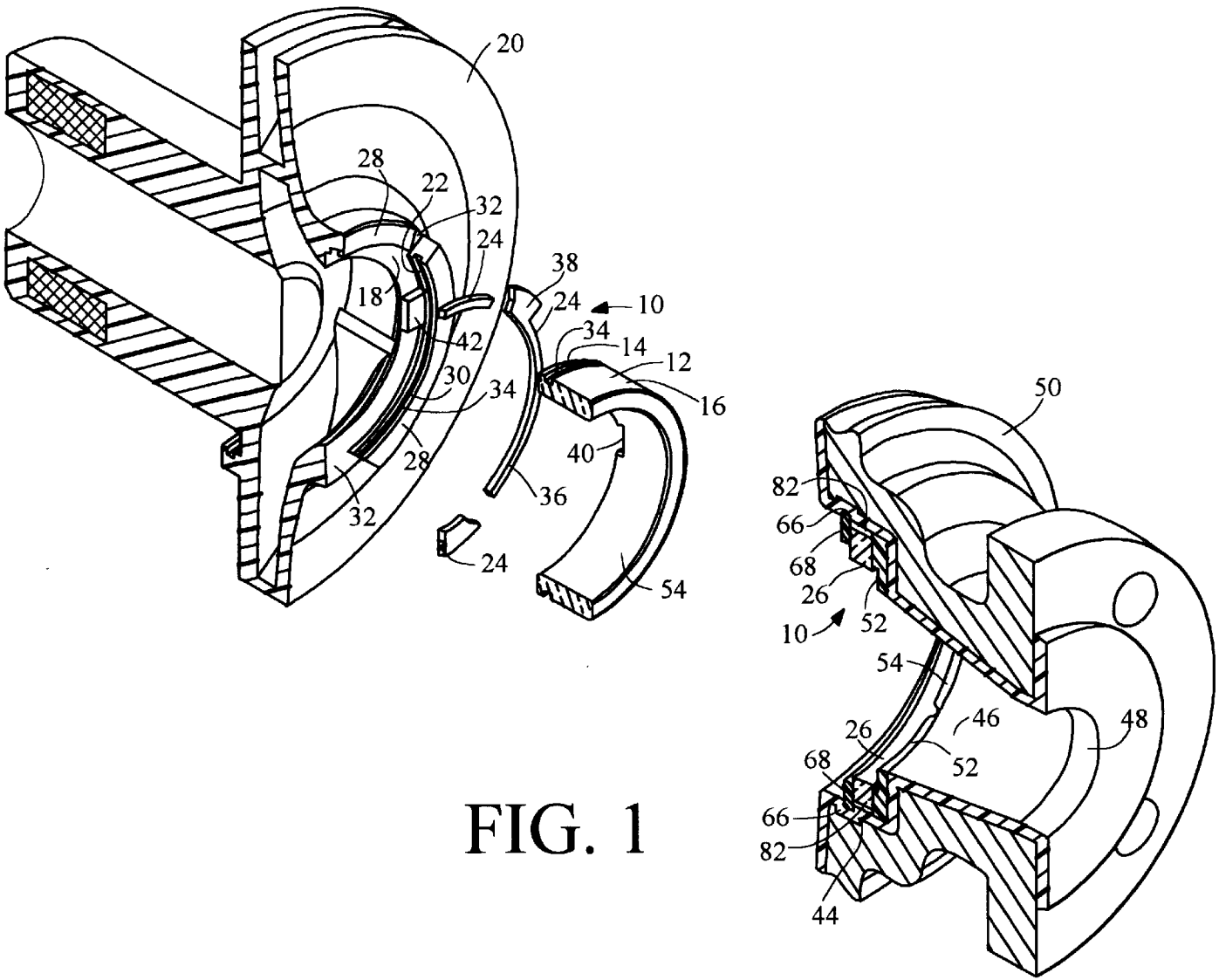
FIG. 1 through FIG. 3 are exploded, cross-sectional views of a first wear ring assembly in accordance with the invention.
Figure 2:
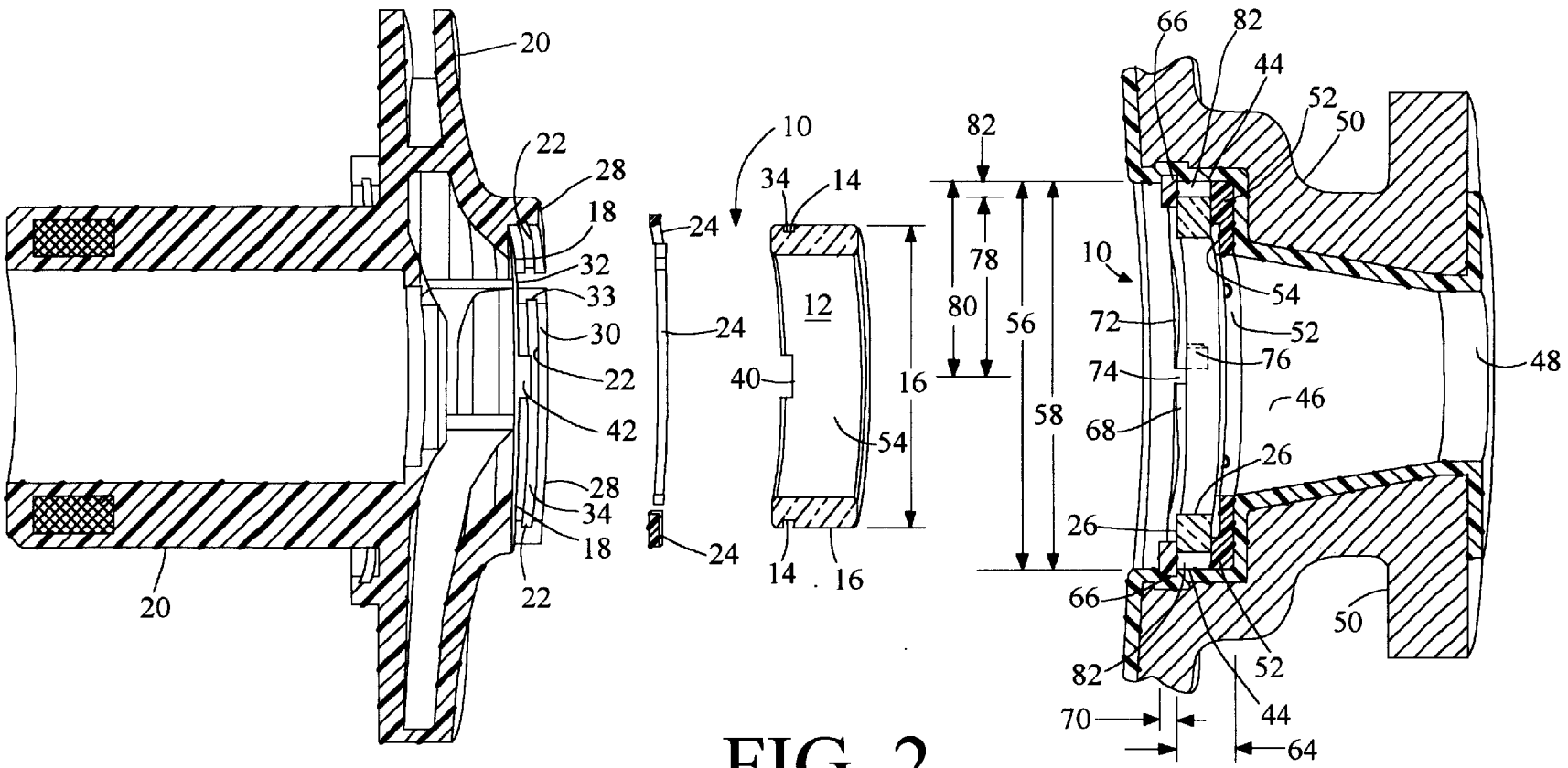
Figure 3:
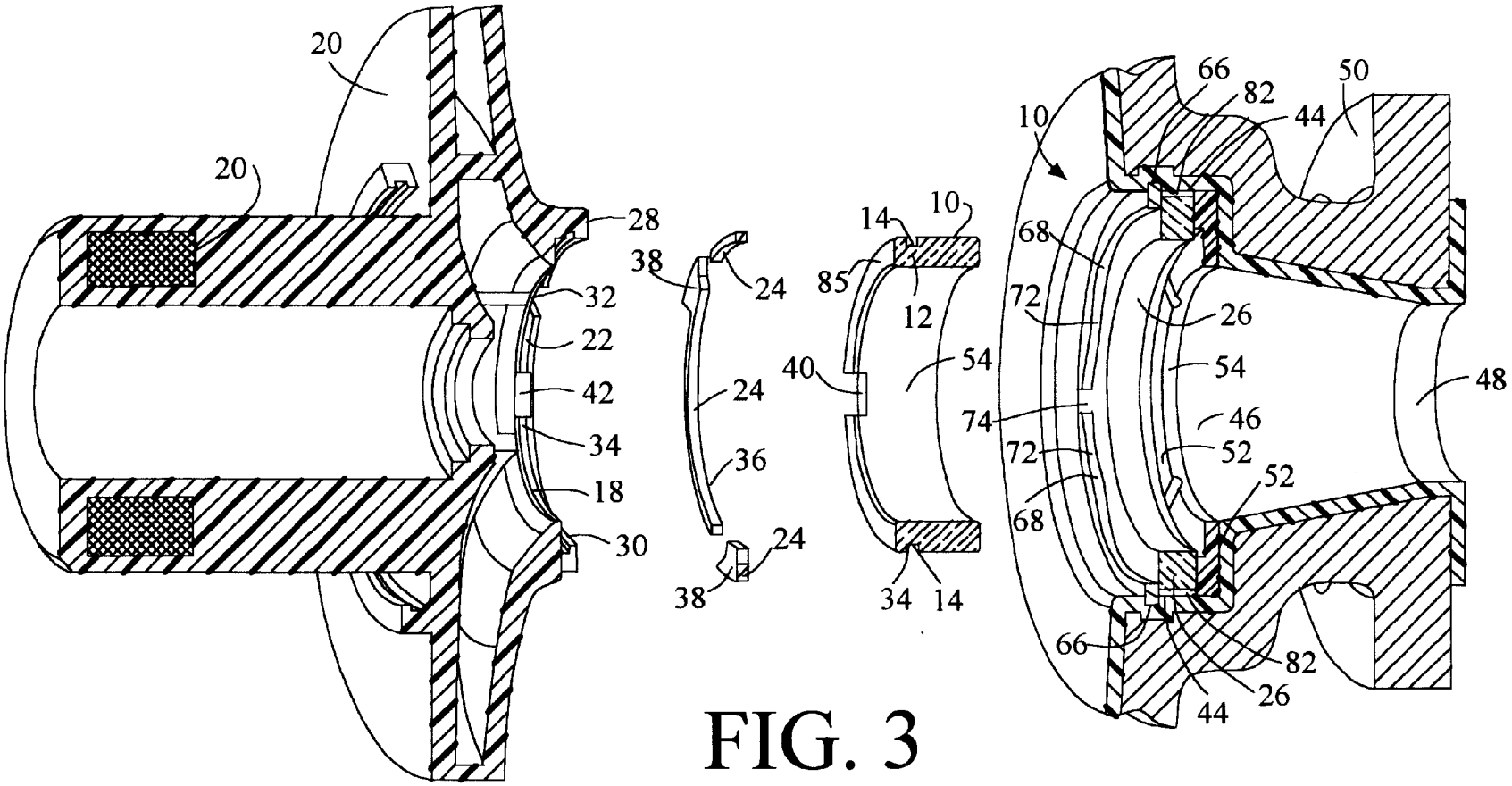

In accordance with the invention, FIG. 1 through FIG. 3 show a first wear ring assembly 10 for a pump including a first inner wear ring 12 with an exterior groove 14. For example, the exterior groove 14 may comprise a circumferential channel about an outer circumference 16 of the first inner wear ring 12. A first inner recess 18 in the impeller 20 receives the first inner wear ring 12. The first inner recess 18 has an interior groove 22 for axial alignment with the exterior groove 14. One or more substantially arcuate retainers 24 simultaneously engage the interior groove 22 and the exterior groove 14 to retain the first inner wear ring 12 relative to the impeller 20. As used herein, arcuate refers to an arch, a bow-like curve, or an arc of a circle. A first outer wear ring 26 cooperates with the first inner wear ring 12 and is generally coaxially oriented with respect to the first inner wear ring 12.

The impeller 20 has a front annular shoulder 28 extending axially frontward from the impeller 20. The front annular shoulder 28 defines the first inner recess 18 or a socket. The interior groove 22 may comprise a circumferential channel about an inner circumference 30 of the first inner recess 18. The front annular shoulder 28 includes depressions 32 extending axially into the front annular shoulder 28. The depressions 32 may be formed as cutouts or slots in the front annular shoulder 28. The depressions 32 are spaced apart from one another within the front annular shoulder 28.

In one embodiment, when the interior groove 22 and the exterior groove 14 are aligned, they form a generally annular hollow 34. Curved or arcuate retainers 24 are inserted into the annular hollow 34 to redundantly fasten the first inner wear ring 12 to the impeller 20. Even if one arcuate retainer 24 were to fail, other arcuate retainers 24 would be available to continue to secure the first inner wear ring 12 to the impeller 20, maintaining reliable pump operation. Each arcuate retainer 24 is readily inserted into the annular hollow 34 via a corresponding depression 32 in the front annular shoulder 28. Once the arcuate retainers 24 are inserted into the annular hollow 34, the arcuate retainers 24 may bend or otherwise conform to the shape of the annular hollow 34.

Although each arcuate retainer 24 may define an arc of any number of degrees less than 360 degrees, each arcuate retainer 24 preferably defines an arc of less than 90 degrees to facilitate insertion of multiple arcuate retainers 24 in the annular hollow 34 during assembly. In a preferred embodiment, the arcuate retainers 24 engage at least 90 percent of the circumference of the annular hollow 34 to maximize the retaining reliability and resistance to shock associated with the mounting of the first inner wear ring 12 on the impeller 20.

Each arcuate retainer 24 includes an arched portion 36 terminating in a stop 38. Although the stop 38 is solid and continuous as shown, in an alternate embodiment the stop may have a slit that divides the stop into two portions to foster additional flexibility. After installation each of the stops 38 is held captive within a corresponding depression 32 or at least against a side 33 of a corresponding depression 32. The stops 38 mate with corresponding depressions 32 to prevent unintentional removal or disengagement of the arcuate retainers 24 from the interior groove 22 and the exterior groove 14. For example, the stops 38 may correspond in size and shape with the depressions 32 to facilitate interlocking engagement. The interaction of the stops 38 with the depressions 32 keep the arcuate retainers 24 in a fixed, stabile position during operation of the pump despite rotation of the impeller 20 and any attendant vibration of the pump. The depressions 32 may be elongated relative to the corresponding stops 38 to permit ready disassembly of the first inner wear ring 12 from the impeller 20 for maintenance. Accordingly, the depressions 32 may be elongated at downstream sides away from the rotational direction of the pump because the rotational direction locks the arcuate retainers 24 in place against the upstream sides 33 of the depressions 32.

If the arcuate retainer 24 is bent during installation to substantially conform to an arc portion of the annular hollow 34, the arcuate retainer 24 is composed of a material with sufficient flexibility or ductility so as not to yield or suffer any significant stress-damage. Each arcuate retainer 24 may be composed of a corrosion-resistant or caustic-resistant material. For example, the arcuate retainer 24 may be composed of a fiber-filled polymer, a fiber-filled plastic, a plastic composite, a plastic, a polymer, an alloy, or a metallic material. Alternately, each arcuate retainer 24 may comprise a core (e.g., a metallic member) protected and covered with a corrosion-resistant sheathing or coating.

The first inner wear ring 12 is arranged for rotation with the impeller 20, while the first outer wear ring 26 is stationary with respect to the pump. In one embodiment, the first inner wear ring 12 has a drive receptor 40 for receiving torque imparted by a drive imparter 42 of the impeller 20. For example, the drive receptor 40 comprises a notch in a face 85 of the first inner wear ring 12 and the drive imparter 42 comprises a protrusion of the impeller 20 for interlocking engagement with the notch. The protrusion corresponds in size and shape to the notch. The drive imparter 42 may be located in the first inner recess 18 of the impeller 20. The drive imparter 42 and the drive receptor 40 cooperate to ensure that rotational movement takes place at the interface between the first inner wear ring 12 and the first outer wear ring 26, rather than elsewhere with regards to the first wear ring assembly 10, during operation of the pump.

The first outer wear ring 26 is disposed in a first outer recess 44 associated with a front housing member 50. For example, the first outer recess 44 may be defined in an interior 46 of the front housing member 50 near an inlet 48 of a pump. In preparation for installing the first wear ring assembly 10, a first outer recess 44 receives an annular member 52 prior to receiving the first outer wear ring 26. The annular member 52 preferably cooperates with the first inner wear ring 12 to form an auxiliary axial thrust bearing 54. The outer diameter 56 of the annular member 52 generally coincides with a recess diameter 58 to allow the annular member 52 to be slid or pressed into place. In contrast, a radial clearance 82 refers to a gap between the first outer wear ring 26 and the first outer recess 44 to allow radial movement and self-centering action of the first outer wear ring 26 into an equilibrium position during rotation of the impeller 20. The first outer wear ring 26 and the annular member 52 have a combined axial thickness which equals a first axial dimension 64 of the first outer recess 44.

A retention channel 66 or step extends radially outward within the first outer recess 44 at approximately the first axial dimension 64 away from a full forward extent of the first outer recess 44. The position of the retention channel 66 may be varied to accommodate the ringlike retainer 68 such that the ringlike retainer 68 holds the first outer wear ring 26 in a generally fixed position, which may be adjusted from time to time in accordance with self-centering movement. The ringlike retainer 68 engages the retention channel 66. The ringlike retainer 68 has an axially compressible dimension 70 biased against the first outer wear ring 26 to force the first outer wear ring 26 axially into the first outer recess 44. A ringlike retainer 68 preferably has a generally wavy axial profile 72 to provide a spring tension if axially compressed. The ringlike retainer 68 is generally circular except for a gap 74 or discontinuity in the circle and an integral key 76 extending from the ringlike retainer 68 near the gap 74.

The axially compressible dimension 70 may be embodied as a wavy profile that provides spring tension or an opposing force upon axial compression of the ringlike retainer 68. The wavy axial profile 72 has crests and troughs. Spacing between adjacent crests may depend upon the yield strength of the material because flattening out the ringlike retainer 68 too much could cause permanent elastic deformation of the ringlike retainer 68, which would result in the partial loss of spring force upon compression. The ringlike retainer 68 preferably has enough pre-load to prevent liquid from leaking behind the first outer wear ring 26 and to prevent the first outer wear ring 26 from moving due to ordinary vibrations during operation of the pump.

The ringlike retainer 68 is preferably composed of carbon-fiber filled polymer or a suitable filler in a polymeric matrix. For example, the ringlike retainer is preferably made from ethylene tetrafluoroethylene.

In an alternate embodiment, the ringlike retainer is composed of stainless steel, a metal, a corrosion-resistant alloy, a metallic base treated with a corrosion-resistant coating, or another suitable configuration. The retention channel 66 in the recess is deeper to accept the metal or alloy ring, than in the case of a polymer-based ring. The metallic ring can be under radial tension when installed. A ring compressor or ring pliers are usually required to install such a metallic ring to keep it under tension.

In another alternate embodiment, instead of using a discontinuous wavy ring like the ringlike retainer 68, a discontinuous coned ring is placed into the retention channel 66 so as to resiliently deform the coned ring into a flat ring against the first outer wear ring 26. In still another alternate embodiment, the actual cross-sectional shape of an alternate ring is not critical so long as the alternate ring is twisted to impart some pretensioning and so long as the alternate ring as able to interlock with the retention channel 66. In yet another alternate embodiment, a ringlike retainer may comprise one or more spring-loaded arcs of 180 degrees or less.

In one embodiment, the first outer wear ring 26 has a first outer radius 78. The first outer recess 44 has a second outer radius 80 greater than the first outer radius 78 to form a radial clearance 82 between the first outer wear ring 26 and the first outer recess 44. The first outer wear ring 26 may radially move within the radial clearance 82 if friction caused by a biasing force of the axially compressible dimension 70 of the ringlike retainer 68 is overcome.

The integral key 76 in the ringlike retainer 68 keeps the first outer wear ring 26 from rotating. The integral key 76 projects axially outward from the ringlike retainer 68. The integral key 76 may have a polyhedral shape, as indicated by the dashed lines, or may be shaped in another way that permits interlocking engagement with a corresponding receptacle, such as an aggregate slot. Advantageously, the one piece construction of the ringlike retainer 68 eliminates potential loss of the integral key 76 during assembly and during manufacturing operations. In a modern automated assembly plant, the unitary construction that combines the integral key 76 and ringlike retainer 68 reduces assembly time, inventory tracking, and other manufacturing costs. The integral key 76 may be varied in length to accommodate outer wear rings of different axial thickness. The integral key 76 may prevent unwanted displacement of the ringlike retainer 68 that otherwise might occur from vibration during pump operation or radially aligning movement of the first outer wear ring 26.

The first outer wear ring 26 has a notch (not shown) extending radially inward from its outer circumference. The notch may be aligned with a corresponding keyway (not shown) in first outer recess 44, as defined by a housing member 50 or otherwise. The ringlike retainer 68 has the integral key 76 for engaging the aligned notch and the keyway to maintain a stationary state of the first outer wear ring 26 with respect to the housing member 50. The integral key 76 extends axially from the ringlike retainer 68 to conform to a size and shape of an aggregate slot formed by the union of the notch and the keyway.

In an alternate embodiment, the integral key 76 could be deleted from the ringlike retainer 68 and replaced by a separate rectangular key.

In another alternate embodiment, if the outer wear ring features multiple notches, the outer retainer may have a corresponding number of multiple keys radially extending from the outer retainer.

Although FIG. 1 through FIG. 3 show an annular member 52 arranged with the first inner wear ring 12 to form an auxiliary thrust bearing 54, in an alternate embodiment the annular member 52 may be omitted and the first outer recess 44 modified such that the auxiliary thrust bearing 54 is not present. As shown, the inner diameter of the annular member 52 is less than the inner diameter of the first outer wear ring 26 so that the first inner wear ring 12 can contact the annular member 52 in response to axial thrust. Accordingly, the annular member 52 preferably has an annular surface area extending inward from the first outer wear ring 26 that corresponds in surface area to an annular surface area of the first inner wear ring 12 for cooperation therewith to form the auxiliary thrust bearing 54.

The first inner wear ring 12 and the first outer wear ring 26 are preferably composed of a ceramic material or a ceramic composite. Ceramic materials, such as silicon carbide, offer excellent corrosion-resistance and longevity in comparison to many of their metal or alloy counterparts.

The first inner wear ring 12 is connected to an impeller front of the impeller 20 and is coaxially aligned with an impeller hub. Advantageously, the first inner wear ring 12 may be mounted in compression within a first inner recess 18 of the impeller 20. The first inner wear ring 12 has a transition fit, which may be loose-fit, a press-fit, or the like. However, if the first inner wear ring 12 is pressed into the first inner recess 18, the first inner wear ring 12 is exposed to compressive forces, which are well-tolerated by ceramic materials.

The first inner wear ring 12 is preferably mounted such that its inner circumference is adjacent to or coextensive with an eye of the impeller 20 to minimize an annular clearance area between the first inner wear ring 12 and the first outer wear ring 26 for a given size of the impeller 20. Accordingly, the minimized annular clearance area facilitates reduced leakage of pumped fluid between discharge pressure and suction pressure than would otherwise be possible with other mounting positions of the first inner wear ring 12 on the impeller 12.

Figure 4:
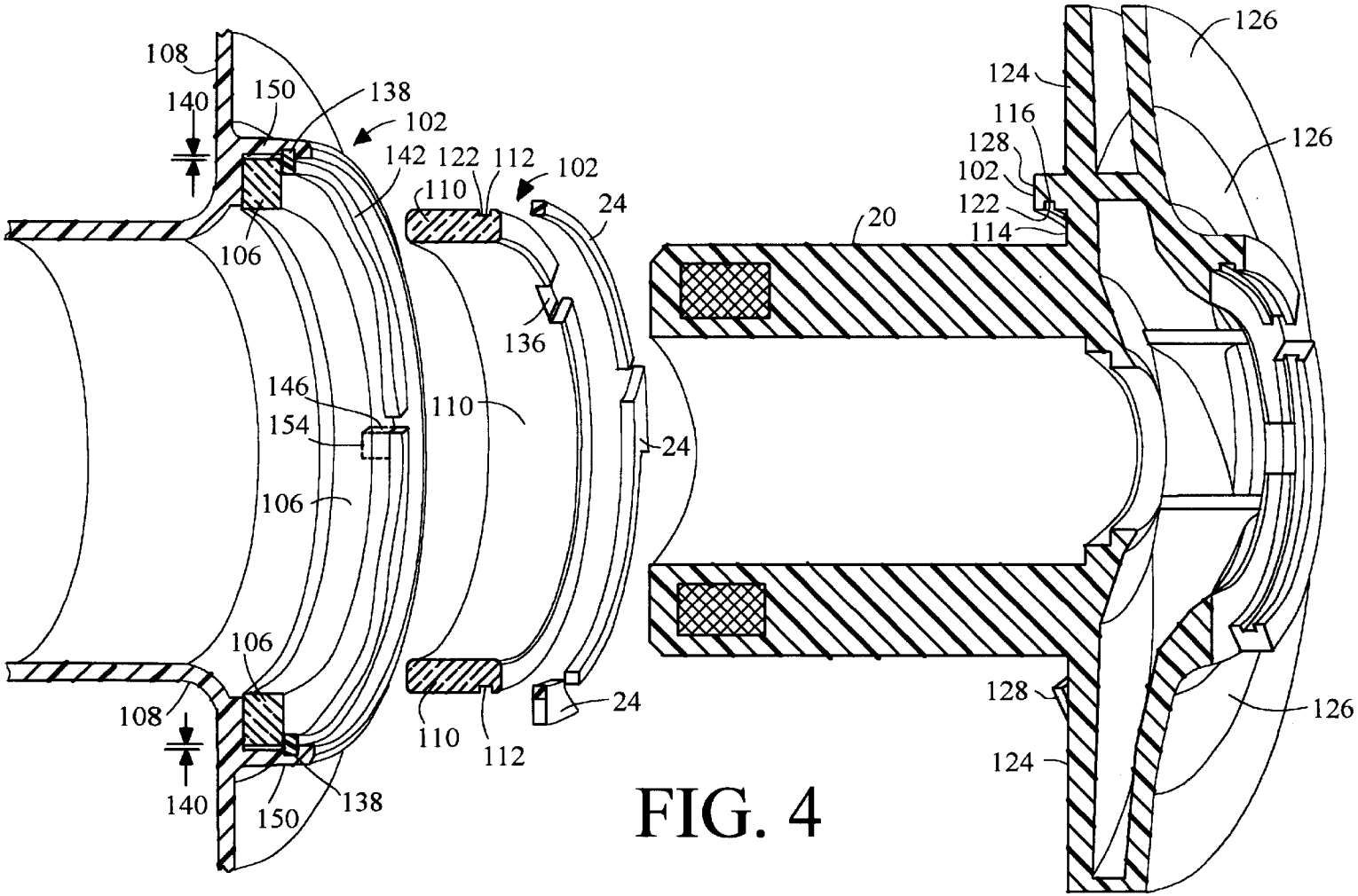
FIG. 4 and FIG. 5 are exploded, cross-sectional views of a second wear ring assembly in accordance with the invention.
Figure 5:
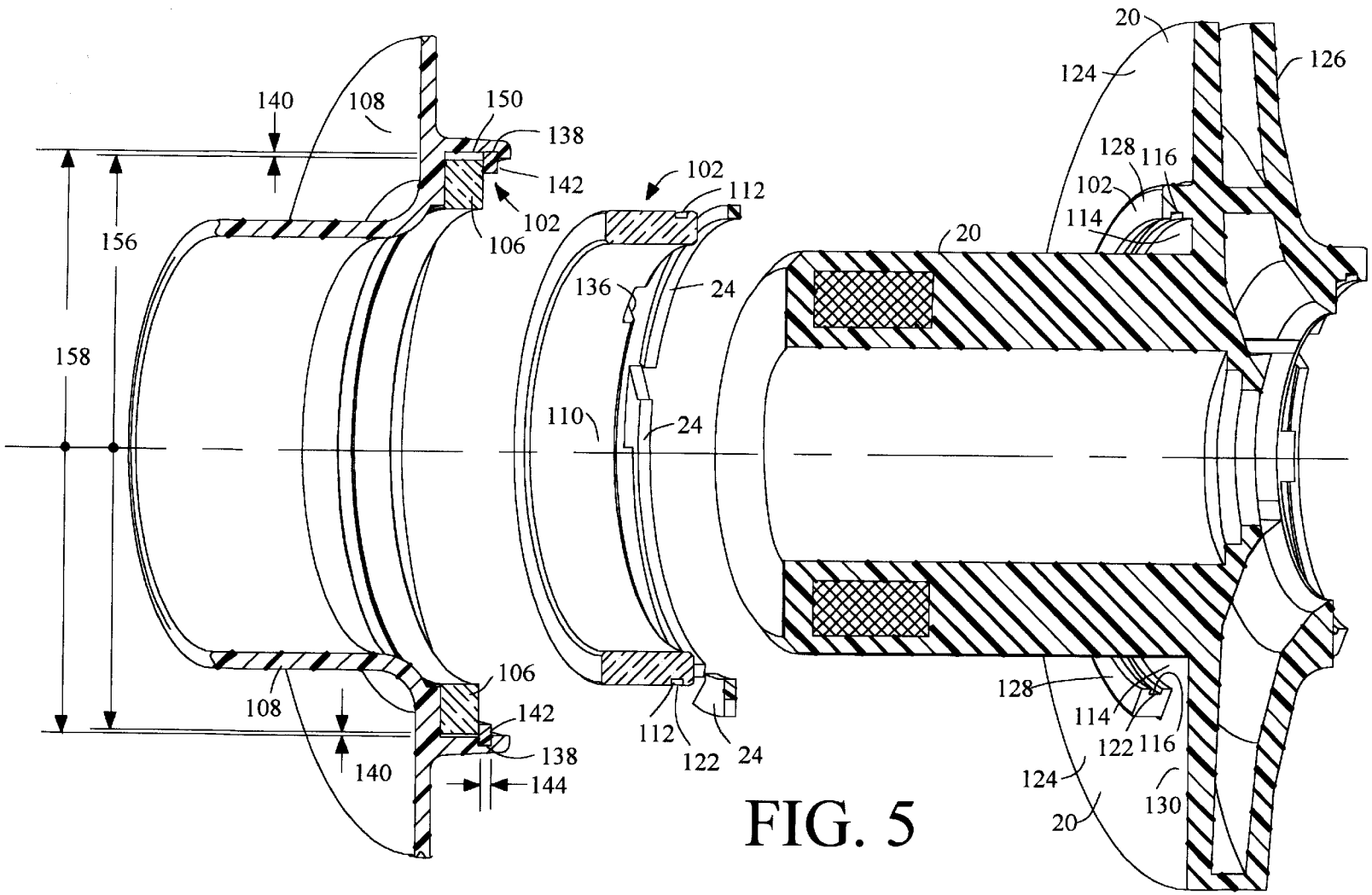

FIG. 4 and FIG. 5 show the second wear ring assembly 102, which is similar to the first wear ring assembly 10 of FIG. 1 through FIG. 3 except for the following main differences. First, the second wear ring assembly 102 is located on an opposite side of the impeller 20 from the first wear ring assembly 10, although in other applications the second wear ring assembly 102 could be located elsewhere in a pump. Second, a second outer wear ring 106 of the second wear ring assembly 102 is mounted to a different housing member (.e.g., containment member 108) than the first outer wear ring 26 of the first wear ring assembly 10. Third, the second wear ring assembly 102 and the first wear ring assembly 10 may have different size wear rings to accommodate thrust balancing, internal pump geometry, or both. Fourth, the second wear ring assembly 102, as illustrated, does not operate in tandem with an annular member 52 to provide an auxiliary thrust bearing as the first wear ring assembly 10 does. Nevertheless, an optional auxiliary thrust bearing could be added to the second wear ring assembly 102 if desired. Like reference numerals indicate like elements in FIG. 1 through FIG. 5.

The second wear ring assembly 102 for a pump includes a second inner wear ring 110 with an exterior groove 112. A second inner recess 114 in the impeller 20 receives the second inner wear ring 110 of the second wear ring assembly 102. The second inner recess 114 has an interior groove 116 for axial alignment with the exterior groove 112. One or more substantially arcuate retainers 24 simultaneously engages the interior groove 116 and the exterior groove 112 to retain the second inner wear ring 110 relative to the impeller 20. A second outer wear ring 106 cooperates with the second inner wear ring 110 and is generally coaxially oriented with respect to the second inner wear ring 110. When the interior groove 116 and the exterior groove 112 are aligned, the interior groove 116 and the exterior groove 112 preferably form a generally annular hollow 122.

The impeller back 124 supports the second inner wear ring 110 in a similar arrangement to the impeller front 126 supporting the first inner wear ring 12. The impeller 20 has a back annular shoulder 128 extending axially rearward from the impeller back 124. The back annular shoulder 128 defines the second inner recess 114. The back annular shoulder 128 includes depressions 132 extending axially into the back annular shoulder 128. The depressions 132 may be formed as cutouts or slots in the back annular shoulder 128. The depressions 132 are spaced apart from one another within the back annular shoulder 128. The impeller 20 includes a drive imparter (not shown) for imparting torque to the second inner wear ring 110 through engagement with its corresponding drive receptor 136.

In practice, a different number of the same arcuate retainers 24 may be used in the impeller front 126 and the impeller back 124 to secure the first inner wear ring 12 and the second inner wear ring 110, respectively, to the impeller 20. Sharing the same arcuate retainers 24 is feasible by selecting an appropriate arc length for the arcuate retainer 24 based on the relative outer diameters of the first inner wear ring 12 and the second inner wear ring 110. Accordingly, the arcuate retainer 24 is well-suited for facilitating manufacturing economies of scale.

The second outer recess 150 has a retention channel 138. The second outer recess 150 provides a radial clearance 140 between the second outer wear ring 106 and second outer recess 150. A ringlike retainer 142 engages the retention channel 138. The ringlike retainer 142 has an axially compressible dimension 144 biased against the second outer wear ring 106 to force the second outer wear ring 106 axially into the second outer recess 150.

The second outer wear ring 106 has a notch 146 that may be aligned with a corresponding keyway in the second outer recess 150. A containment member 108 or another housing member defines the second outer recess 150 and the keyway. The containment member 108 is generally shaped like a pot, although as illustrated various sections of the containment member 108 are cut away. The notch 146 preferably extends radially into an exterior circumference of the second outer wear ring 106. The ringlike retainer 142 has an integral key 154 for engaging the notch 146 and the keyway to maintain a stationary state of the second outer wear ring 106 with respect to the containment member 108. For the second wear ring assembly 102, the second outer wear ring 106 may be sealed against the containment member 108 to avoid leakage loss. Nevertheless, the hydraulic forces within the pump tend to seat or press the first outer wear ring 26 into the first outer recess 44 and the second outer wear ring 106 into the second outer recess 150.

In one embodiment, the second outer wear ring 106 has a first outer radius 156 and the second outer recess 150 has a second outer radius 158 greater than the first outer radius 156 to permit relative radial movement within the radial clearance 140 between the second outer wear ring 106 and the second outer recess 150 if a biasing force of the axially compressible profile is overcome. The second outer wear ring 106 is self-centering to compensate for eccentricity of assembly between the second inner wear ring 110 and the second outer wear ring 106.

The second inner wear ring 110 and the second outer wear ring 106 are preferably composed of a ceramic material or a ceramic composite. Ceramic materials, such as silicon carbide, offer excellent corrosion-resistance and longevity in comparison to many of their metal or alloy counterparts. The materials for the inner wear ring and the outer wear ring are tribologically compatible with each other to prevent galling of the materials from any potential friction.

Figure 6:
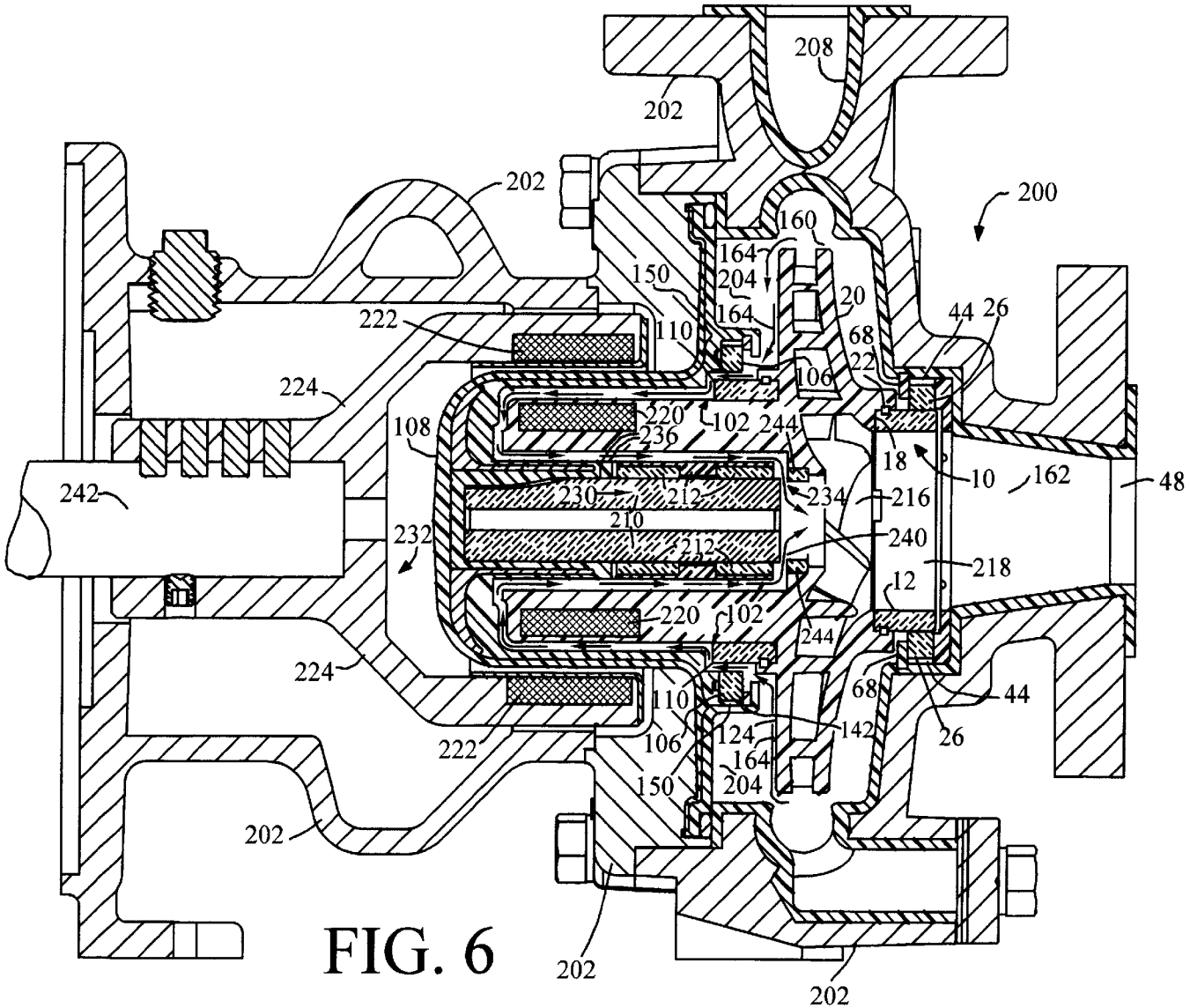
FIG. 6 is a cross-sectional view of a pump incorporating the first wear ring assembly and the second wear ring assembly.

As illustrated in FIG. 6, the second inner wear ring 110 cooperates with the second outer wear ring 106 to restrict the flow or leakage of fluid from a discharge chamber 160 to a suction chamber 162 via a secondary flow path 164. The first inner wear ring 12 defines a front planar, circular region and the second inner wear ring 110 defines a rear planar, circular region that has a greater surface area than that of the front, planar circular region. In a preferred embodiment, the front surface area is approximately seventy percent or less of the back surface area because of thrust balancing concerns.

In accordance with the invention, FIG. 6 shows a centrifugal pump 200 incorporating the first wear ring assembly 10 and the second wear ring assembly 102. Like reference numbers in FIG. 1 through FIG. 6 indicate like elements. Although FIG. 6 shows a magnetic-drive pump, the first wear ring assembly 10, the second wear ring assembly 102, or both may be incorporated into any type of centrifugal pump 200.

A centrifugal pump 200 includes a housing assembly 202 defining a pump cavity 204, an inlet 48, and an outlet 208. A shaft 210 is disposed in the pump cavity 204. A radial bearing 212 coaxially surrounds the shaft 210. The shaft 210 and the radial bearing 212 are rotatable with respect to one another. An impeller 20 is positioned to receive a fluid from the inlet 48 and to exhaust a fluid to the outlet 208. The impeller 20 has a first inner recess 18 with an interior groove 22. While the pump is operated, fluid from an inlet 48 flows into an eye 216 of the impeller 20 through a generally cylindrical hollow 218 defined by the first inner wear ring 12.

A first magnet assembly 220 is preferably associated with the impeller 20 such that the first magnet assembly 220 and the impeller 20 rotate simultaneously. The first magnet assembly 220 may be integrated into the impeller 20 as shown in FIG. 1 through FIG. 6. A second magnet assembly 222 is preferably coaxially oriented with respect to the first magnet assembly 220. The second magnet assembly 222 permits coupling to a drive shaft 242 through a containment member 108. The second magnet assembly 222 is carried by a rotor 224. A drive motor (not shown) is capable of rotating the drive shaft 242 and the rotor 224.

The containment member 108 is oriented between the first magnet assembly 220 and the second magnet assembly 222. The containment member 108 is sealed to another portion of the housing 202 for containing the pumped fluid to a wet-end 230 of the pump 200 and isolating the pumped fluid from a dry-end 232 of the pump 200. The containment member 108 is preferably made from a dielectric. For example, the containment member 108 is composed of a reinforced polymer, a reinforced plastic, a plastic composite, a polymer composite, a ceramic, a ceramic composite, a reinforced ceramic, or the like. The containment member 108 may feature a multilayer construction as shown or a single layer construction. The containment member 108 may be constructed from carbon fiber filled ethylene tetrafluoroethylene (ETFE), polytetrafluoroethylene (PTFE), or another structurally suitable composition.

A containment member 108 or another housing member provides a second outer recess 150 for a second outer wear ring 106. Although the second outer recess 150 could support a rear auxiliary thrust ring, a rear auxiliary thrust ring in the pump is not needed because of the axial thrust balancing system of the present pump. Moreover, the impeller 20 tends to be forced forward during transient periods of operation or cavitation.

The thrust balancing system includes a thrust balancing valve 234 acting in cooperation with the second wear ring assembly 102, circulation channels 236 in the radial bearing 212, and an impeller back 124. The thrust balancing valve 234 is an adjustable valve with an opening 240 that changes in response to changes in axial loads on the impeller 20, which in turn affects the hydraulic axial force applied to an impeller back 124. The thrust balancing valve 234 is formed by the opening 240 between the shaft 210 and the seating ring 244. The thrust balancing system manages a secondary fluid flow path 164 from the discharge chamber 160 through the second wear ring assembly 102, toward a rear of the containment member 108, and then forward through circulation channels 236 in the radial bearing 212. The secondary fluid path continues from the radial bearing 212 toward the suction chamber 162 via the thrust balancing valve 234. The axial thrust balancing system encourages the impeller 20 to float at an intermediate axial position between its extreme axial positions. The impeller 20 does not ordinarily bounce back and forth between the opposite axial extreme positions during ordinary operation, but rather predominately takes a stabile intermediate axial position. For a complete description of the axial balancing system, refer to co-pending U.S. application Ser. No. 09/267,440, entitled CENTRIFUGAL PUMP 200 HAVING AN AXIAL THRUST BALANCING SYSTEM, which is hereby incorporated by reference herein.

The first inner wear ring 12 cooperates with the first outer wear ring 26 to restrict the flow or leakage of fluid from a discharge chamber 160 to a suction chamber 162. The inner diameter of the first outer wear ring 26 and the outer diameter of the first inner wear ring 12 have a clearance to provide a tolerable leakage between the first inner wear ring 12 and the first outer wear ring 26 during normal operation of the pump 200. The clearance depends to some extent on the material with which the first inner wear ring 12, the first outer wear ring 26, or both are made. Further, other pump clearances and tolerances may affect the clearances between the first inner wear ring 12 and the first outer wear ring 26.

The first outer recess 44 is associated with the housing assembly 202. In one embodiment, the first wear ring assembly 10 includes retaining means for retaining the first outer wear ring 26 in the first outer recess 44 and for compensating for eccentric misalignment between the first inner wear ring 12 and the first outer wear ring 26. Similarly, the second wear ring assembly 102 includes retaining means for retaining the second outer wear ring 106 in the second outer recess 150 and for compensating for eccentric misalignment between the second inner wear ring 110 and the second outer wear ring 106. The foregoing retaining means refer to a combination of the ringlike retainer (e.g., 68 or 142), the retention channel (e.g., 66 or 138), for the ringlike retainer and the first outer wear ring 26 or the second outer wear ring 106.

The first outer wear ring 26 can compensate for eccentricity of assembly between the first outer wear ring 26 and the first inner wear ring 12. Similarly, the second outer wear ring 106 can compensate for eccentricity of assembly between the second outer wear ring 106 and the second inner wear ring 110. The first outer wear ring 26 and the second outer wear ring 106 can move radially in reaction to change in radial loads or force within the boundaries provided by the first outer recess 44 and the second outer recess 150, respectively. The ringlike retainers (68, 142) form springs that initially press the first outer wear ring 26 and the second outer wear ring 106 into the first outer recess 44 and the second outer recess 150, respectively. Further, during operation of the pump 200, hydraulic forces further force the first outer wear ring 26 and the second outer wear ring 106 axially into the first outer recess 44 and the second outer recess 150, respectively. The ringlike retainers (68, 142) provide frictional resistance to movement of the first outer wear ring 26 and the second outer wear ring 106, which may be overcome during transient pump activity, such as starting, stopping, discontinuities or other changes in fluid flow. Nevertheless, the ringlike retainer (68, 142) contributes to the net forces on the first outer wear ring 26 and the second outer wear ring 106, regardless of whether the ringlike retainer (68, 142) produces the dominant force acting on the first outer wear ring 26 and the second outer wear ring 106.

The first outer recess 44 is associated with the housing assembly 202 or a support within the pump cavity 204. A ringlike retainer 68 is adapted to retain the first outer wear ring 26 in the first outer recess 44 with a retentive axial force. The first outer recess 44 has a greater radial extent than that of the first outer wear ring 26 to provide a radial clearance 82 (FIG. 2). For example, the first outer recess 44 has a first radius greater than a second radius of the first outer wear ring 26 to provide a radial clearance 82. The radial clearance 82 allows radial movement of the first outer ring to coaxially align the first outer wear ring 26 with respect to the first inner wear ring 12 if a frictional resistance from the retentive axial force of the ringlike retainer 68 is overcome. The radial clearance 82 is such that the first outer wear ring 26 resists radial movement or moves radially, tempered by a frictional resistance from the retentive axial force and cushioned upon contacting a periphery of the first outer recess 44 to reduce radial shock transmitted to the first outer wear ring 26 from the first inner wear ring 12.

The second outer recess 150 is associated with the containment member 108 or another component of the housing assembly 202. Components of the housing assembly include a rear casing member or a containment member 108, either of which may define the second outer recess. A ringlike retainer 142 is adapted to retain the second outer wear ring 106 in the second outer recess 150 with a retentive axial force. The second outer recess 150 has a greater radial extent than that of the second outer wear ring 106 to provide a radial clearance 140 (FIG. 4). For example, the second outer recess 150 has a first radius greater than a second radius of the second outer wear ring 106 to provide a radial clearance 140. The radial clearance 140 allows radial movement of the second outer wear ring 106 to coaxially align the second outer wear ring 106 with respect to the second inner wear ring 110 if a frictional resistance from the retentive axial force of the ringlike retainer 142 is overcome. The radial clearance 140 is such that the second outer wear ring 106 resists radial movement or moves radially, tempered by a frictional resistance from the retentive axial force and cushioned upon contacting a periphery of the second outer recess 150 to reduce radial shock transmitted to the second outer wear ring 106 from the second inner wear ring 110.

The tolerances of any pump 200 are subject to manufacturing processes, material limitations, and other fabrication constraints. Here, the first inner wear ring 12 and the second inner wear ring 110 rotates with the impeller 20 during normal operation of the pump 200. During such rotation incidental contact may occur between the inner diameter of the first outer wear ring 26 and the outer diameter of the first inner wear ring 12, for example. The incidental contact is transient and causes minimal or no wear to the contacting surfaces. The incidental contact may occur during pump start-up, priming, changes in flow or changes in viscosity of the pumped fluid, or the like. The incidental contact triggers the self-aligning properties associated with the first wear ring assembly 10, the second wear ring assembly 102, or both. In response to contact, the axial tension provided by the ringlike retainer 68, that presses the first outer wear ring 26 axially into the first outer recess 44, is momentarily or instantaneously overcome such that the first outer wear ring 26 moves to a new position of radial alignment in the first outer recess 44 or another radially oversized recess. Accordingly, the new position is preferably one of equilibrium that represents a radial self-centering of the rotational axis of the pump that partially or entirely compensates for manufacturing tolerance or other tolerance variations in the pump 200. Axial movement is permitted between the first inner wear ring 12 and the first outer wear ring 26 of the first wear ring assembly 10 and the second inner wear ring 110 and the second outer wear ring 106 of the second wear ring assembly 102 between the extremes and within a range of operational and axial positions.

Although the first outer wear ring 26 could have been press-fitted into the first outer recess 44, the first outer wear ring 26 would then be unable to find its center of geometry during operation of the pump 200. Instead, the center of geometry would depend upon tolerances associated with the press-fit in a hole as an analog for the first outer recess 44 in an alternate embodiment.

Ideally, the first outer recess 44 and the second outer recess 150 would be entirely concentric with the shaft 210. The first outer wear ring 26 is ideally also concentric with the shaft 210. In a pump using plastic or polymer construction, tolerance control is more difficult than in all metallic pumps. Accordingly, the self-aligning first outer wear ring 26 and second outer wear ring 106 of the present invention are well suited for application to pumps using plastic or polymer construction, ceramic shafts, and even pumps using cast iron casings with polymer-coated pump interiors.

In an alternate embodiment, the first wear ring assembly 10, the second wear ring assembly 102, or both may form, in effect, a shock-absorbing bushing by a combination of the first outer wear ring 26, the first outer recess 44, and ringlike retainer (e.g., 68) for applying a retentive force to the first outer wear ring 26 in the first outer recess 44. The shock-absorbing bushing is capable of absorbing energy by mechanical resistance associated with the retentive force and by frictional, radial movement, if the retentive force is overcome.

The first inner wear ring 12 and the second inner wear ring 110 are mounted in a similar or equivalent manner. The arcuate retainers 24 and the ringlike retainer 68 affords ready removal of the first inner wear ring 12 and the first outer wear ring 26, respectively, for replacement. For instance, one can use pliers or pliers and a screw driver to remove the first inner wear ring 12, the first outer wear ring 26, or both. If a first inner wear ring 12, a second inner wear ring 110, a first outer wear ring 26, or a second outer wear ring 106 chips or is otherwise damaged, the foregoing wear ring is easy to replace. To install the first outer wear ring 26 or the second outer wear ring 106, a gauge may be used to line up the outer wear ring in an appropriate, radially centered position within the pump interior 46. For example, the gauge may comprise a cylindrical jig that fits in the inner diameter of the second outer wear ring 106 to permit centering of the second outer wear ring 106.

Although the first inner wear ring 12 and the second inner wear ring 110 are affixed to the impeller 20 via arcuate retainers 24, as previously described herein, in an alternate embodiment, the first inner wear ring 12, the second inner wear ring 110, or both are affixed to the retainer via a plurality of fasteners (e.g., set screws) with shafts extending radially to tangentially contact an outer circumference of the inner wear ring (e.g., 12 or 110).

Figure 7:
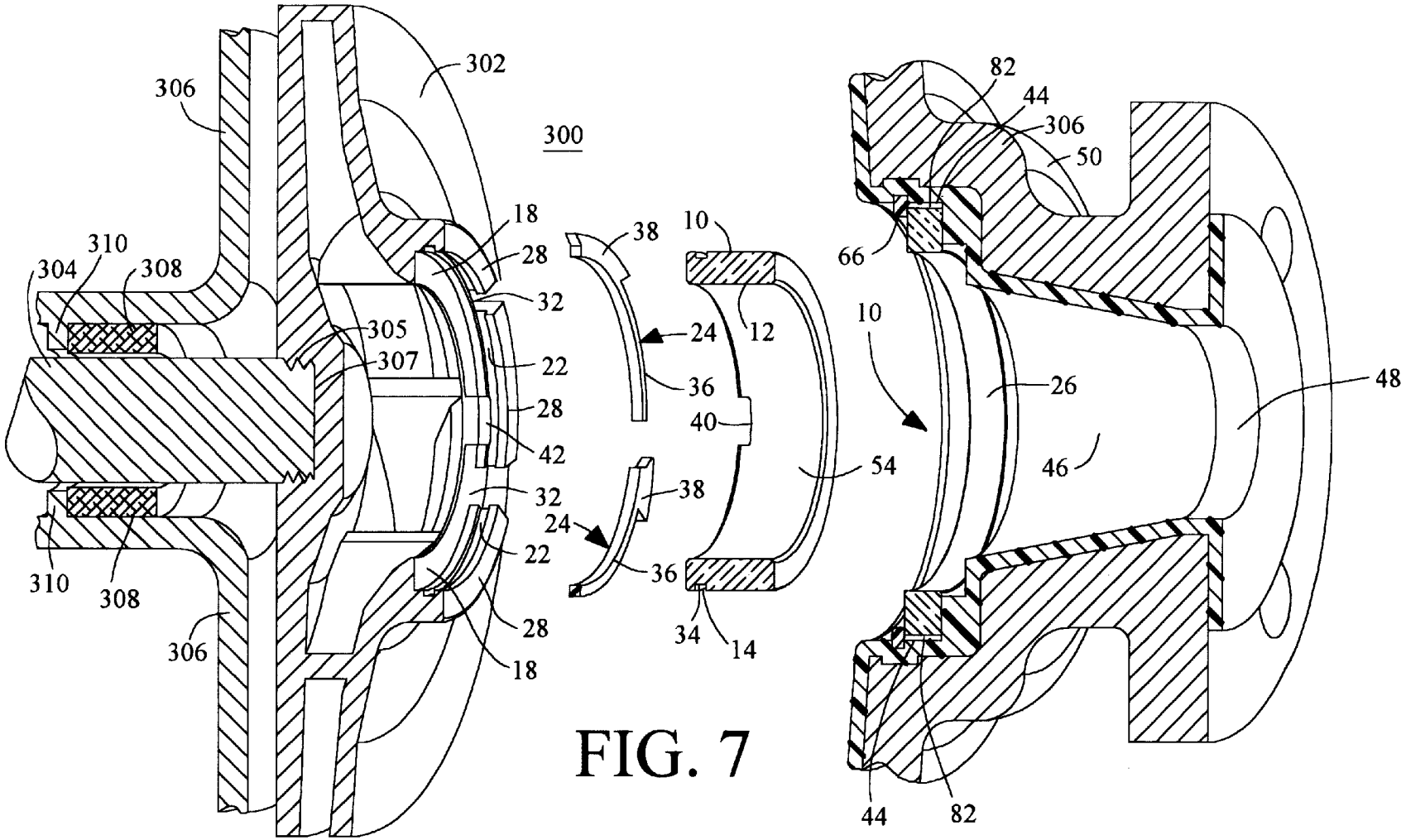
FIG. 7 and FIG. 8 are exploded, cross-sectional views of an alternate embodiment of a pump including a wear ring assembly.
Figure 8:
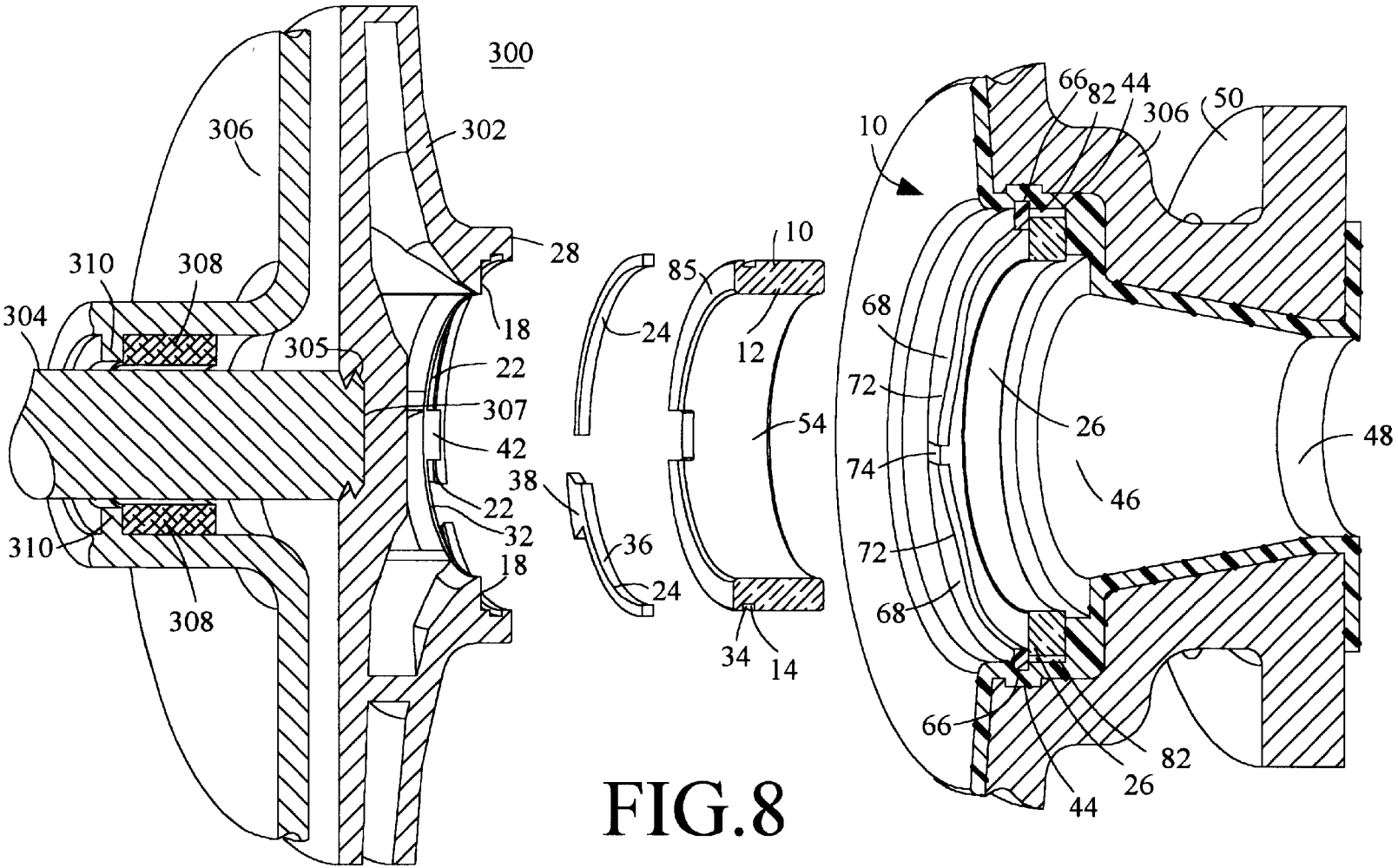

FIG. 7 and FIG. 8 show exploded, cross-sectional perspective views of an alternate embodiment of a centrifugal pump section 300 incorporating the first wear ring assembly 10. Like reference numbers indicate like elements in FIG. 1, FIG. 2, FIG. 3, FIG. 7, and FIG. 8. FIG. 7 and FIG. 8 illustrate that the first wear ring assembly 10 may be installed in any type of centrifugal pump regardless of whether or not the centrifugal pump is a magnetic-drive centrifugal pump. Further, FIG. 7 and FIG. 8 illustrate that the first wear ring assembly 10 may be installed in a centrifugal pump without an accompanying second wear ring assembly (e.g., second wear ring assembly 102). Such a pump configuration with a single wear ring assembly is particularly appropriate where a centrifugal pump or a magnetic-drive centrifugal pump does not feature hydraulic thrust balancing.

The centrifugal pump section 300 of FIG. 7 and FIG. 8 differs from the section of the magnetic-drive centrifugal pump of FIG. 1 through FIG. 3 because the centrifugal pump section 300 includes an impeller 302 connected to a shaft 304 for rotation with the shaft 304. As shown, the shaft 304 has external threads 305 that mate with corresponding internal threads of a generally cylindrical recess 307 in the impeller 302. A pump housing 306 supports a radial bearing 308 that rests against a radially extending ledge 310 of the pump housing 306. The radial bearing 308 is coaxially oriented with respect to the shaft 304 and supports radial loads from the impeller 302.

The centrifugal pump section 300 does not include a containment member 108 or other features of a magnetic-drive pump. Instead, the pump section 300 includes a mechanical shaft seal (not shown) downstream from the radial bearing 308 to prevent the leakage of pumped fluid outside of the pump housing 306.

The foregoing detailed description is provided in sufficient detail to enable one of ordinary skill in the art to make and use the wear ring assembly and the associated pump of the invention. The foregoing detailed description is merely illustrative of several physical embodiments of the wear ring assembly and the pump. Physical variations of the wear ring assembly or the pump, not fully described in the specification, are encompassed within the purview of the claims. Accordingly, the narrow description of the elements in the specification should be used for general guidance rather than to unduly restrict the broader descriptions of the elements in the following claims.

We claim:

1. A wear ring assembly for a pump having an impeller, the wear ring assembly comprising:

an inner wear ring with a exterior groove;

an inner recess in the impeller for receiving the inner wear ring, the recess having an interior groove for axial alignment with the exterior groove;

at least one substantially arcuate retainer for simultaneously engaging the interior groove and the exterior groove to retain the inner wear ring relative to the impeller; and an outer wear ring cooperating with the inner wear ring and generally coaxially oriented with respect to the inner wear ring.

2. The wear ring assembly according to claim 1 wherein the interior groove and the exterior groove form a generally annular hollow and wherein a plurality of arcuate retainers conform to the shape of the annular hollow to redundantly fasten the inner wear ring to the impeller.

3. The wear ring assembly according to claim 1 wherein the at least one arcuate retainer includes an arched portion terminating in a stop.

4. The wear ring assembly according to claim 1 wherein the at least one retainer defines an arc of less than 90 degrees.

5. The wear ring assembly according to claim 1 wherein the at least one retainer is composed of a corrosion-resistant material selected from the group consisting of a fiber-filled polymer, a fiber-filled plastic, a plastic composite, and a plastic polymer and wherein the inner wear ring is composed of a ceramic material.

6. The wear ring assembly according to claim 1 wherein the impeller includes an annular shoulder defining the inner recess and extending axially outward from the impeller, a plurality of depressions extending axially into the annular shoulder, the at least one retainer having a stop for engaging a corresponding one of said depressions.

7. The wear ring assembly according to claim 1 wherein the impeller has an annular shoulder and the inner recess is located in the annular shoulder.

8. The wear ring assembly according to claim 1 wherein the inner wear ring has a drive receptor and wherein the inner recess has a drive imparter for engagement with the drive receptor.

9. The wear ring assembly according to claim 8 wherein the drive receptor comprises a notch and wherein the drive imparter comprises a protrusion corresponding in size and shape to the notch.

10. The wear ring assembly according to claim 1 wherein the outer wear ring is stationary with respect to the pump.

11. A wear ring assembly for a pump having a pump casing and an impeller, the wear ring assembly comprising:

an outer wear ring;

an outer recess associated with the pump casing for receiving the outer wear ring, the outer recess having a retention channel and providing a radial clearance between the outer wear ring and outer recess;

a ringlike retainer engaging the retention channel and having an axially compressible profile biased against the outer wear ring to force the outer wear ring axially into the outer recess;

an inner wear ring arranged for rotation with the impeller and coaxially oriented with respect to the outer wear ring.

12. The wear ring assembly according to claim 11 wherein the outer wear ring has a first outer radius and the outer recess has a second outer radius greater than the first outer radius to permit relative radial movement within the radial clearance between the outer wear ring and the outer recess if a biasing force of the axially compressible profile is overcome.

13. The wear ring assembly according to claim 11 wherein the axially compressible profile comprises a wavy profile that provides spring tension or an opposing force upon axial compression of the ringlike retainer.

14. The wear ring assembly according to claim 11 wherein the axially compressible profile comprises a wavy profile with crests and troughs, adjacent crests being separated an amount sufficient to prevent a permanent stress deformation of the ringlike retainer composed of a polymeric matrix.

15. The wear ring assembly according to claim 11 wherein the outer wear ring has a notch and wherein the ringlike retainer has an integral key for engaging the notch to maintain a stationary state of the outer wear ring with respect to the pump casing.

16. The wear ring assembly according to claim 11 wherein the outer wear ring has a notch extending into an exterior diameter of the outer wear ring and wherein an integral key extends axially from the ringlike retainer to conform to a size and s h ape of the notch.

17. A centrifugal pump comprising:

a housing assembly defining a pump cavity, an inlet, and an outlet;

a shaft disposed in the pump cavity;

a radial bearing coaxially surrounding said shaft, the shaft and the radial bearing being rotatable with respect to one another;

an impeller positioned to receive a fluid from the inlet and to exhaust a fluid to the outlet, the impeller having a first inner recess with an interior groove;

a first wear ring assembly including a first inner wear ring in the first inner recess and a first outer wear ring coaxially oriented with respect to the first inner wear ring, the first inner wear ring having an exterior groove for axial alignment with the interior groove; and a plurality of curved retainers for simultaneously engaging the interior groove and the exterior groove to retain the first inner wear ring relative to the impeller.

18. The centrifugal pump according to claim 17 wherein each of the curved retainers defines an arc of less than 90 degrees.

19. The centrifugal pump according to claim 17 wherein each of the curved retainers includes an arched portion terminating in a stop.

20. The centrifugal pump according to claim 19 wherein the impeller has an annular shoulder defining the first inner recess, the annular shoulder including a plurality of depressions extending axially into the annular shoulder, each of the depressions adapted to receive a corresponding stop.

21. The centrifugal pump according to claim 17 further comprising:

a first outer recess associated with the housing assembly; and retaining means for retaining the first outer wear ring in the first outer recess and for compensating for eccentric misalignment between the first inner wear ring and the first outer wear ring.

22. The centrifugal pump according to claim 17 further comprising:

a first outer recess associated with the housing assembly; and a shock-absorbing bushing formed by a combination of the first outer wear ring, the first outer recess, and ringlike retainer for applying a retentive force to the first outer wear ring in the first outer recess, the shock-absorbing bushing capable of absorbing energy by mechanical resistance associated with the retentive force and by frictional, radial movement, if the retentive force is overcome.

23. The centrifugal pump according to claim 17 further comprising:

a first outer recess associated with the housing assembly;

an axial thrust bearing disposed in the first outer recess and extending radially inward with respect to the first outer wear ring; and a ringlike retainer for retaining the first outer wear ring in the first outer recess with a retentive axial force.

24. A centrifugal pump comprising:

a housing assembly defining a pump cavity, an inlet, and an outlet;

a shaft disposed in the pump cavity;

a radial bearing coaxially surrounding said shaft, the shaft and the radial bearing being rotatable with respect to one another;

an impeller positioned to receive a fluid from the inlet and to exhaust a fluid to the outlet, the impeller having a first inner recess with an interior groove;

a first wear ring assembly including a first inner wear ring in the first inner recess and a first outer wear ring coaxially oriented with respect to the first inner wear ring, the first inner wear ring having an exterior groove for axial alignment with the interior groove; and a plurality of curved retainers for simultaneously engaging the interior groove and the exterior groove to retain the first inner wear ring relative to the impeller;

a first outer recess associated with the housing assembly; and a ringlike retainer for retaining the first outer wear ring in the first outer recess with a retentive axial force.

25. The centrifugal pump according to claim 24 wherein the first outer recess has a first radius greater than a second radius of the first outer wear ring to provide a radial adjustment clearance such that the first outer ring can move radially to coaxially align the first outer wear ring with respect to the first inner wear ring if a frictional resistance from the retentive axial force of the ringlike retainer is overcome.

26. The centrifugal pump according to claim 24 wherein the first outer recess has a greater radial extent than that of the first outer wear ring to provide a radial clearance such that the first outer wear ring resists radial movement or moves radially, tempered by a frictional resistance from the retentive axial force and cushioned upon contacting a periphery of the first outer recess to reduce radial shock transmitted to the first outer wear ring from the first inner wear ring.

27. The centrifugal pump according to claim 24 wherein ringlike retainer has an axially compressible dimension to provide axial tension against the first outer wear ring.

28. The centrifugal pump according to claim 24 wherein the ringlike retainer has a wavy profile to provide axial tension against the first outer wear ring.

29. The centrifugal pump according to claim 24 wherein the ringlike retainer is generally conical profile to provide axial tension against the first outer wear ring.

30. The centrifugal pump according to claim 24 further comprising:

a second outer recess associated with the housing assembly and having a retention channel;

a second wear ring assembly including a second inner wear ring arranged for rotation with the impeller and a second outer wear ring received by the second outer recess, the second outer wear ring having a notch and coaxially oriented with respect to the second inner wear ring;

a ringlike member having an axially compressible profile partially engaged in the retention channel and biased against the second outer wear ring to force the second outer wear ring axially into the rear recess of greater axial extent than that of the second outer wear ring.

31. The centrifugal pump according to claim 30 wherein the second wear ring assembly is disposed on an opposite side of the impeller from the first wear ring assembly.

32. The centrifugal pump according to claim 30 wherein the housing assembly includes a containment member and wherein the second outer recess is located in the containment member.

33. The centrifugal pump according to claim 30 wherein the housing assembly includes a housing member and wherein the second outer recess is located in the housing member.

34. The centrifugal pump according to claim 30 wherein the impeller includes an impeller front with the first inner recess for receiving the first inner wear ring and an impeller rear with the second inner recess for receiving the second wear ring.

35. The centrifugal pump according to claim 30 wherein the second inner wear ring has an exterior groove, the second inner recess having an interior groove for axial alignment with the exterior groove, a plurality of curved retainers simultaneously engaging the interior groove and the exterior groove.

* * * * *